US006153362A

United States Patent [19]

Nair et al.

[11] Patent Number: 6,153,362

[45] Date of Patent: Nov. 28, 2000

[54] OVERCOAT FOR RETICULATION CONTROL IN PHOTOGRAPHIC ELEMENTS

[75] Inventors: Mridula Nair, Penfield; Lloyd A. Lobo, Webster; Tamara K. Jones, Rochester, all of N.Y.

[73] Assignee: Eastman Kodak Company, Rochester, N.Y.

[21] Appl. No.: 09/313,556

[22] Filed: May 14, 1999

[51] Int. Cl.[7] ..... G03C 1/76; G03C 1/91; G03C 8/15; G03C 1/89; G03C 11/08

[52] U.S. Cl. ..... 430/350; 430/505; 430/572; 430/527; 430/531; 430/536; 430/961; 430/533; 430/432; 430/434

[58] Field of Search ..... 430/531, 536, 430/350, 961, 527, 512, 505, 533, 432, 434

[56] References Cited

U.S. PATENT DOCUMENTS

| | | | |
|---|---|---|---|
| 2,454,043 | 11/1948 | Dimsdale et al. . | |
| 2,588,765 | 3/1952 | Robijns . | |
| 2,732,305 | 1/1956 | Richman et al. . | |
| 2,761,791 | 9/1956 | Russell . | |
| 2,976,148 | 3/1961 | Walford . | |
| 3,025,779 | 3/1962 | Russell et al. . | |
| 3,042,522 | 7/1962 | Ben-Ezra . | |
| 3,080,317 | 3/1963 | Tallet et al. . | |
| 3,121,060 | 2/1964 | Duane . | |
| 3,147,090 | 9/1964 | Russell et al. . | |
| 3,206,311 | 9/1965 | Campbell et al. . | |
| 3,489,567 | 1/1970 | McGraw . | |
| 3,502,473 | 3/1970 | Snellman et al. . | |
| 3,508,947 | 4/1970 | Hughes . | |
| 3,933,516 | 1/1976 | Mackey . | |
| 4,004,927 | 1/1977 | Yamamoto et al. . | |
| 4,047,958 | 9/1977 | Yoneyama et al. . | |
| 4,279,945 | 7/1981 | Audran et al. . | |
| 4,302,523 | 11/1981 | Audran et al. . | |
| 4,427,964 | 1/1984 | Ruegsegger . | |
| 5,447,832 | 9/1995 | Wang et al. | 430/527 |
| 5,695,920 | 12/1997 | Anderson et al. | 430/531 |
| 5,804,360 | 9/1998 | Schell et al. | 430/531 |
| 5,853,926 | 12/1998 | Bohan et al. | 430/531 |
| 5,853,965 | 12/1998 | Haydock et al. . | |
| 5,866,282 | 2/1999 | Bourdelais et al. . | |
| 5,874,205 | 2/1999 | Bourdelais et al. . | |
| 5,888,643 | 3/1999 | Aylward et al. . | |
| 5,888,681 | 3/1999 | Gula et al. . | |
| 5,888,683 | 3/1999 | Gula et al. . | |
| 5,888,714 | 3/1999 | Bourdelais et al. . | |

FOREIGN PATENT DOCUMENTS

| | | |
|---|---|---|
| 1284294 | 11/1968 | Germany . |
| 1284295 | 11/1968 | Germany . |
| 955061 | 4/1964 | United Kingdom . |
| 1143118 | 2/1969 | United Kingdom . |
| 1198387 | 7/1970 | United Kingdom . |
| 1263722 | 2/1972 | United Kingdom . |
| 1320565 | 6/1973 | United Kingdom . |
| 1320756 | 6/1973 | United Kingdom . |
| 1320757 | 6/1973 | United Kingdom . |
| 1430997 | 4/1976 | United Kingdom . |
| 1466304 | 3/1977 | United Kingdom . |

OTHER PUBLICATIONS

B. Jirgensons, "Organic Colloids", Elsevier Publishing Company, 1958, p. 14.

R. L. Davidson, editor, "Handbook of Water–Soluble Gums and Resins", McGraw–Hill Book Company, 1980.

T. H. James, editor, "The Theory of the Photographic Process," 4th Edition, Macmillan Publishing Co., Inc. 1977.

Research Disclosure No. 34390, Nov. 1992, Photographic Light–Sensitive Silver Halide Film Can Comprise A Transparent Magnetic Recording Layer, Usually Provided On The Backside Of The Photographic Support.

Research Disclosure No. 37038, Feb. 1995, Typical And Preferred Colored Paper, Color Negative, And Color Reversal Photographic Elements and Processing.

Research Disclosure No. 308119, Dec. 1989, Photographic Silver Halide Emulsions, Preparations, Addenda, Processing and Systems.

Research Disclosure No. 36230, Jun. 1994, Combinations of Technology Useful in a Small Format Film.

Research Disclosure No. 38957, Sep. 1996, Photographic Silver Halide Emulsions, Preparations, Addenda, Systems and Processing.

Research Disclosure No. 37040, Feb. 1995, Heated and/or Cooled Liquid Inflator system.

Research Disclosure No. 17643, Dec. 1978, Photographic Silver Halide Emulsions, Preparations, Addenda, Processing and Systems.

*Primary Examiner*—Richard L. Schilling
*Attorney, Agent, or Firm*—Carl F. Ruoff

[57] ABSTRACT

A photographic element containing a support; at least two contiguous layers, at least one of which is a silver halide emulsion layer superposed on a side of said support; a processing solution permeable protective overcoat containing a urethane-vinyl copolymer having acid functionalities wherein a weight ratio of a urethane component in the copolymer comprises from 20 to 100 percent and a weight ratio of a vinyl component in the copolymer comprises from 0 to 80 percent; a crosslinker for the said copolymer; and a second polymer selected from the group consisting of polyvinyl alcohol, cellulose ethers, n-vinyl amides, polyesters, poly(ethylene oxide), starch, proteins, whey, albumin, poly (acrylic acid), alginates and gums overlying the said at least two contiguous layers; and wherein the ratio of the gelatin to non-gelatin content of the dried layers immediately underlying the uppermost gelatin layer is less than 1.3 with the proviso that the water content of the wet coating of all the gelatin layers prior to drying is at a coverage of greater than 53 g/m$^2$.

16 Claims, No Drawings

OVERCOAT FOR RETICULATION CONTROL IN PHOTOGRAPHIC ELEMENTS

FIELD OF THE INVENTION

The present invention relates to photographic elements and the problem of reticulation.

BACKGROUND OF THE INVENTION

The use of gelatin, a hydrophilic colloid, as the binding agent or vehicle in photographic silver halide emulsions and other components such as couplers, is well known. Such loaded layers do not have good abrasion resistance and must therefore usually be coated with an overcoat layer. It has been found that overcoat layers, containing gelatin and mixtures of gelatin and other hydrophilic colloids are suitable for this purpose. The addition of certain materials to both the silver halide layer and the overcoat layer improves resistance to abrasion, particularly when processed in high speed automatic processing equipment such as described in U.S. Pat. Nos. 3,147,090 and 3,025,779. The use of high-speed, high-temperature processing of these materials, however, results in a reticulation problem in the photographic element.

Reticulation or extensive layer buckling in an irregular pattern is a serious problem and occurs when the uppermost layer of a photographic element is a gelatin-containing layer that has a lateral swell coefficient greater than the lower gelatin-containing layers. Since the top layer is the only one not confined at both boundaries, it has more freedom to swell laterally. Thus, any gelatin based coating is inherently prone to reticulation. Large lateral swelling tendencies are produced when layers are coated in a manner under conditions that include high drying temperature, high wet coverage, and short low temperature chilling. The web temperature, in the dryer of the coating machine, controls the triple helix crosslink formation of gelatin. In general, the higher the temperature, the less the number of crosslinks formed and the higher is the differential in the lateral swell. The ratio of the gelatin vs non gelatin material in the underlying layers, relative to the top layer also contributes to lateral swell. In order to minimize the lateral swell differential, low ratio is desired in the top layer and a high ratio is desired in the underlying layers.

When gelatin-containing layers are rewet, such as during processing, the gelatin structure in each of the layers swells as it absorbs aqueous processing solutions. Usually, since the uppermost layer has less non-swelling material per volume of coating than does the lower layer, it can absorb more water and swell more. Most of this swell is in the vertical direction. However, when the horizontal or lateral swell occurs, the tendency for each of the layers to swell to different lengths causes large swelling stresses between the uppermost layer and the contiguous lower layer and a buckling of the surface of the uppermost layer occurs when these stresses are relieved during drying. The differential horizontal swell between layers can be minimized if the proper crosslinked structure of the gelatin has been developed during the coating and drying operation. The structure of the dried, coated element is strongly affected by the rate of drying and the temperature of drying subsequent to the coating operation as mentioned before. During most coating operations the web temperature is increased along the length of the drier, in order to dry the coated element completely. The gelatin concentration in the coated element also increases along the length of the drier as a result of drying. The web temperature at which the gelatin concentration is between 15% and 60% is critical to the formation of the triple helix structure, which affects the amount of reticulation. As the amount of water load in the coating is increased, the critical gelatin concentration is achieved at the later sections of the drier, thus increasing the web temperature in this critical region. Because of this, products coated with high water loads, are more prone to reticulation, in operations where the drier capacity is limited. However, reducing the amount of water, can cause other problems, such as increase in viscosity, or increase in the shear thinning propensity of the coating solutions. As the drying time, during manufacture, is extended, the risk of reticulation is lessened. However, this slows down the coating speed resulting in a more expensive process and reduced production capacity of the photographic element in machines which are limited in drying capacity. Under these constraints it is desirable to manufacture the product without having to increase the dryer capacity, and without a reticulation problem.

While reticulation occurs mainly in gelatin containing multilayer elements, that is, elements having at least one pair of contiguous gelatin containing layers, it can also occur in single layer elements where a single gelatin layer is coated on a relatively nonswellable support.

The elements of the coating operation that contribute to this problem are the overall high water content of the coating composition and the low gelatin to non-gelatin content of the lower layers compared to the upper most gelatin containing layer of emulsion side of the photographic element in conjunction with high speed coating and drying operations. For example, commonly owned U.S. Ser. No. 09/299,395, filed Apr. 26, 1999 and U.S. Ser. No. 09/299,548, filed Apr. 26, 1999, disclose a photographic element which is prone to severe reticulation if it is coated above a speed of 900 ft/min. It is desired to manufacture this material at speeds higher than 900 ft/min, in order to reduce the unit manufacturing cost, without installing extra dryers in the machine.

No prior art uncovered discloses a processing solution permeable non-gelatin overcoat which overcomes the problems discussed above. It is therefore highly desirable to provide an imaging element comprising a protective overcoat layer that reduces reticulation of the gelatin containing layers without significantly reducing the rate of reaction of the developer with the underlying emulsions.

SUMMARY OF THE INVENTION

The present invention encompasses a photographic element comprising:

- a support;
- at least two contiguous layers, at least one of which is a silver halide emulsion layer superposed on a side of said support;
- a processing solution permeable protective overcoat comprising:
  - a urethane-vinyl copolymer having acid functionalities wherein a weight ratio of a urethane component in the copolymer comprises from 20 to 100 percent and a weight ratio of a vinyl component in the copolymer comprises from 0 to 80 percent,
  - a crosslinker for said copolymer, and
  - a second polymer selected from the group consisting of polyvinyl alcohol, cellulose ethers, n-vinyl amides, polyesters, poly(ethylene oxide), starch, proteins, whey, albumin, poly(acrylic acid), alginates and gums overlying the said at least two contiguous layers; and wherein the ratio of the gelatin to non-gelatin content of the dried layers immediately underlying the uppermost gelatin layer is less than 1.3 with the proviso that the water content of the wet coating of all the gelatin layers prior to drying is at a coverage of greater than 53 g/m$^2$.

Optionally, the processing solution permeable overcoat may be fused. The resulting photographic element is effective in reducing reticulation after processing and drying. The present invention overcomes the disadvantages of prior art photographic products described above.

The present invention provides color photographic materials that may be imaged over a wide range of exposure times with exceptional images being formed.

Further, the present invention provides color paper materials that are durable, bright, and sharp.

These and other features of the invention may be accomplished, for example, by using a photographic element comprising:

a support;

at least two contiguous layers, at least one of which is a silver halide emulsion layer superposed on a side of said support;

a processing solution permeable protective overcoat comprising:

a urethane-vinyl copolymer having acid functionalities wherein a weight ratio of a urethane component in the copolymer comprises from 20 to 100 percent and a weight ratio of a vinyl component in the copolymer comprises from 0 to 80 percent, a crosslinker for said copolymer, and a second polymer selected from the group consisting of polyvinyl alcohol, cellulose ethers, n-vinyl amides, polyesters, poly(ethylene oxide), starch, proteins, whey, albumin, poly(acrylic acid), alginates and gums overlying the said at least two contiguous layers; and wherein the ratio of the gelatin to non-gelatin content of the dried layers immediately underlying the uppermost gelatin layer is less than 1.3 with the proviso that the water content of the wet coating of all the gelatin layers prior to drying is at a coverage of greater than 53 g/m$^2$; wherein said support material comprises a paper base and a microvoided biaxially oriented polyolefin sheet; and wherein said at least one silver halide emulsion layer superposed on a side of said support has an exposure range of at least 125 nanoseconds to 0.5 seconds when there is a Status A reflection density shoulder loss of no more than 8 percent as a function of the cyan record, wherein said photographic element has an exposure range of at least 125 nanoseconds to 0.5 seconds when there is a Status A reflection density shoulder loss of no more than 8 percent as a function of the magenta color record, wherein said photographic element has an exposure range of at least 125 nanoseconds and 0.5 seconds when there is a Status A reflection density shoulder loss of no more than 4 percent as a function of the yellow color record, and wherein said photographic element has a Status A reflection density minimum of less than 0.078 in the cyan layer, has a Status A reflection density minimum of less than 0.075 in the magenta layer, has a Status A reflection density minimum of less than 0.072 in the yellow layer, and an modulation transfer function (MTF) of at least 78.0.

Such a photographic element is exemplary only and does not represent the full scope of the present invention.

DESCRIPTION OF THE PREFERRED EMBODIMENTS

The present invention provides a photographic element and a method to reduce reticulation while still maintaining processability. The present invention is drawn to the use of a reticulation reducing overcoat as the uppermost layer on the emulsion side of a photographic element, particularly photographic prints. In accordance with the invention, a protective overcoat is applied over the imaging element prior to exposure and processing.

In a particular embodiment, a continuous protective overcoat is applied over a photographic element having at least one silver halide light-sensitive emulsion layer. The protective layer comprises a pH switchable polymer, a crosslinker for the polymer, and a second polymer that is water soluble. The protective overcoat allows excellent permeability of the developer solution at pH greater than 7 and development of the silver halide light sensitive emulsion layer to provide an imaged photographic element. The polymer overcoat may be further coalesced by fusing (heat and/or pressure) if needed after processing, without substantial change or addition of chemicals in the processing step, to form a fully water impermeable protective overcoat with excellent gloss characteristics. Fusing is optional and is preferably done at a temperature of from 25 to 200° C.

Polymers useful in the practice of this invention are urethane polymers, preferably urethane-vinyl copolymers, containing pH responsive groups such as acid functionalities, most preferably urethane-acrylic copolymers having an acid number greater than or equal to 5 and less than or equal to 30, preferably from 10 to 25, most preferably 12 to 20. The weight ratio of the urethane component in the polymer can vary from 20 to 100 percent. The weight ratio of the vinyl component in the polymer can vary from 0 to 80 percent.

The second polymer is chosen from a group of water soluble polymers comprising polyvinyl alcohol and its derivatives, cellulose ethers and their derivatives, n-vinyl amides, functionalized polyesters, poly(ethylene oxide), starch, proteins including gelatin, whey and albumin, poly (acrylic acid) and its homologs, alginates, gums and the like. These yield coatings that free of cracks and do not significantly reduce the diffusion rate of the developer with the underlying emulsions. Preferably, the second polymer comprises polyvinyl alcohol and its derivatives.

In accordance with the present invention, a photographic element comprises a support having thereon at least one light-sensitive layer and coated over the light sensitive layer furthest from the support a continuous layer of polymer having an acid number less than or equal to 30 but greater than or equal to 5 and permeable to water only at pH of greater than 7.

The coating composition in accordance with the invention also contains suitable crosslinking agents. Such additives improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carboduimides, polyvalent metal cations, and the like may all be considered. It is preferred that excessive amounts are not used. The preferred crosslinker is a polyfunctional aziridine crosslinker.

Polyurethanes provide advantageous properties such as good film-formation, good chemical resistance, abrasion-resistance, toughness, elasticity and durability. Further, urethanes exhibit high levels of tensile and flexural strength, good abrasion resistance and resistance to various oils.

Vinyls, especially acrylics, have the added advantage of good adhesion, non-yellowing, are adjustable for high gloss and have a wide range of glass transition and minimum film forming temperatures. The urethane-vinyl copolymers are very different from mere blends of the two. Polymerization of the vinyl monomer in the presence of the polyurethane causes the two polymers to reside in the same latex particle as an interpenetrating or semi-interpenetrating network or as a core shell particle resulting in improved resistance to water, organic solvents and environmental conditions, improved tensile strength and modulus of elasticity. The presence of groups such as carboxylic acid groups provide a conduit for processing solutions to permeate the coating at pH greater than 7. Maintaining the acid number of less than or equal to 30 ensures that overcoat has good adhesion to the substrate below even at high pH and makes the overcoat more water-resistant.

The amount of the second polymer in the overcoat is from 1 to 40 weight percent of the polyurethane-vinyl copolymer, preferably from 5 to 30 weight percent of the polyurethane-vinyl copolymer, most preferably from 10 to 25 weight percent of the polyurethane-vinyl copolymer. The overcoat layer in accordance with this invention is particularly advantageous due to superior physical properties including excellent resistance to water permeability, fingerprinting, fading and yellowing, exceptional transparency and toughness necessary for providing resistance to scratches, abrasion, blocking, and ferrotyping.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874,205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet. Coating compositions for forming the protective overcoat layer in accordance with the present invention comprise a continuous aqueous phase having therein a film forming binder, wherein the binder comprises hybrid urethane-vinyl copolymer having an acid number of greater than or equal to 5 and less than or equal to 30. Acid number is in general determined by titration and is defined as the number of milligrams of potassium hydroxide (KOH) required to neutralize 1 gram of the polymer.

The polymer overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer, dye that will impart color. In addition, additives can be incorporated into the polymer that will give the overcoat, desired properties. For example, a UV absorber can be incorporated into the polymer to make the overcoat UV absorptive, thus protecting the image from UV induced fading.

Other additional compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is fused. For example, in contact fusing the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The preparation of aqueous polyurethane dispersions is well known in the art. In all cases, the first step is the formation of a medium molecular weight isocyanate terminated prepolymer by the reaction of suitable di- or polyol with a stoichiometric excess of di- or polyisocyanates. The prepolymer is then generally dispersed in water via water-solubilizing/dispersing groups that are introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane. When the vinyl component is present in the copolymer, the urethane-vinyl copolymers are produced by polymerizing one or more vinyl monomers in the presence of the polyurethane prepolymer or the chain extended polyurethane, the preferred weight ratio of the chain extended polyurethane to the vinyl monomer being about 4:1 to about 1:4, most preferably about 1:1 to 1:4.

Polyols useful for the preparation of polyurethane dispersions of the present invention include polyester polyols prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. A polyester polyol is preferred for the present invention.

Polyisocyanates useful for making the prepolymer may be aliphatic, aromatic or araliphatic. Examples of suitable polyisocyanates include one or more of the following: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cyclopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'diisocyanatodiphenyl ether, tetramethyl xylene diisocyanate, polymethylene polyphenyl polyisocyanates and the like. Methylene bis(isocyanato cyclohexane) is preferred.

A suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and dispersibility in water. Compounds that are reactive with the isocyanate groups and have a group capable of forming an anion arc as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an $\alpha,\alpha$-dimethylolalkanoic acid, especially 2,2-dimethylol propionic acid.

Suitable tertiary amines which are used to neutralize the acid and form anionic groups for water dispersability are trimethylamine, triethylamine, dimethylaniline, diethylaniline, triphenylamine and the like.

Chain extenders suitable for chain extending the prepolymer are active-hydrogen containing molecules such as polyols, amino alcohols, ammonia, primary or secondary aliphatic, aromatic, alicyclic araliphatic or heterocyclic amines especially diamines. Diamines suitable for chain extension of the prepolyurethane include ethylenediamine, diaminopropane, hexamethylene diamine, hydrazine, aminoethyl ethanolamine and the like.

In accordance with a critical feature of this invention a hybrid urethane-vinyl copolymer is prepared by polymerizing vinyl addition monomers in the presence of the polyurethane prepolymer or the chain extended polyurethane. The solution of the water-dispersible polyurethane prepolymer in vinyl monomer may be produced by dissolving the prepolymer in one or more vinyl monomers before dispersing the prepolymer in water.

Suitable vinyl monomers in which the prepolymer may be dissolved contain one or more polymerizable ethylenically unsaturated groups. Preferred monomers are liquid under the temperature conditions of prepolymer formation although the possibility of using solid monomers in conjunction with organic solvents is not excluded.

The vinyl polymers useful for the present invention include those obtained by interpolymerizing one or more ethylenically unsaturated monomers including, for example, alkyl esters of acrylic or methacrylic acid such as methyl methacrylate, ethyl methacrylate, butyl methacrylate, ethyl acrylatc, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2 -hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

The prepolymer/vinyl monomer solution may be dispersed in water using techniques well known in the art. Preferably, the solution is added to water with agitation or, alternatively, water may be stirred into the solution. Polymerization of the vinyl monomer or monomers is brought about by free radical initiators at elevated temperatures.

Free radicals of any sort may be used including persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron(II) salt, potassium persulfate-sodium hydrogen sulfate, etc.). Preferable free radical initiators are the ones that partition preferably into the oil phase such as the azo-type initiators. Common chain transfer agents or mixtures thereof known in the art, such as alkylmercaptans, can be used to control the polymer molecular weight.

Polymerization may be carried out by one of two methods. In the first method, all of the vinyl monomer (the same or different vinyl monomers or monomer mixtures) is added in order to swell the polyurethane pre-polymer. The monomers are then polymerized using an oil soluble free radical initiator after dispersing the mixture in water.

In the second method, some of vinyl monomer may be added to swell the pre-polymer prior to dispersing in water. The rest of the monomer is fed into the system during the polymerization process.

In either method of polymerization, the vinyl monomers which may be added and polymerized include those mentioned above. Functional monomers such as hydroxyalkyl acrylates and methacrylates may also be incorporated at this stage since the free isocyanate groups of the prepolymer will have reacted with the chain extender.

Some examples of urethane acrylic copolymers used in the practice of this invention that are commercially available are the NeoPac™ R-9000, R-9699 and R-9030 from Zeneca Resins, the Sancure™ AU4010 from BF Goodrich, and the Flexthane™ 620, 630, 790 and 791 from Air Products. An example of the urethane polymer useful in the practice that is commercially available is the NeoReZ™ R9679.

Examples of water soluble polymers include polyvinyl alcohol and its derivatives, cellulose ethers and their derivatives, n-vinyl amides, functionalized polyesters, poly (ethylene oxide), starch, proteins including gelatin, whey and albumin, poly(acrylic acid) and its homologs, alginates, gums and the like. Such materials are included in "Handbook of Water-Soluble Gums and Resins" by Robert I. Davidson (McGraw-Hill Book Company, 1980) or "Organic Colloids" by Bruno Jirgensons (Elsvier Publishing Company, 1958).

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodimide, epoxide, aziridine, vinyl sulfone, sulfinic acid, active methylene, amino, amide, allyl, and the like.

In order to reduce the sliding friction of the photographic elements in accordance with this invention, the urethane-vinyl copolymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as camauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008.

The photographic elements in which the image is to be protected from reticulation, aqueous solutions, abrasion and the like can contain conductive layers. Conductive layers can be incorporated into multilayer imaging elements in any of various configurations depending upon the requirements of the specific imaging element. Preferably, the conductive layer is present as a subbing or tie layer underlying a magnetic recording layer on the side of the support opposite the imaging layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the imaging layer(s) or on both sides of the support. An optional conductive subbing layer can be applied either underlying or overlying a gelatin subbing layer containing an antihalation dye or pigment.

Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an imaging element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the imaging layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of the invention differ widely in structure and composition. For example, the photographic elements vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

The photographic elements claimed in accordance with this invention are derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged photographic elements in accordance with this invention is to protect the element from reticulation and other physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

The photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26,1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The element can contain additional layers, such as filter layers, interlayers, overcoat layers, subbing layers, and the like. All of these can be coated on a support that can be transparent (for example, a film support) or reflective (for example, a paper support). Photographic elements claimed in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

The present invention is illustrated by the following examples:

EXAMPLES

The urethane-acrylic copolymer NeoPac™ R9699 was obtained from Zeneca Resins. The polymer has an acid number of 15. The other urethane-acrylic copolymer P1 was synthesized. The polymer P1 has an acid number of 11. The polyvinyl alcohols (PVA), V2 (Airvol™ 203) was obtained from Air Products and has an average molecular weight of 13–23K and is 87 to 89% hydrolyzed. The crosslinker, CX 100(polyfunctional aziridine), for the acid containing urethane-vinyl copolymers was obtained from Zeneca Resins.

Synthesis of Polymer P1

Into a dry reactor was charged 96 grams of a diol (Millester™ 9-55, MW2000 from Polyurethane Corporation of America), 87 grams of the methylene bis(4-cyclohexyl) isocyanate (Desmodur™ W) and 0.02 grams of dibutyltin dilaurate (Aldrich) and the mixture was held with stirring for 30 minutes at 94° C. after which 12 grams of N-methyl pyrrolidone were added. After another 30 minutes 14 grams of dimethylol propionic acid and 12 grams of N-methyl pyrrolidone were added to the reactor and the mixture stirred for 2.5 hours at 94° C. The resultant prepolymer was cooled to room temperature, dissolved in a vinyl monomer mixture consisting of 113 grams of n-butyl acrylate, 212 grams of methyl methacrylate and 1.5 grams of hexanediol diacrylate and then treated with 11 grams of triethylamine. This solution was added slowly with stirring to another reactor containing 662 grams of distilled water at 25° C. under nitrogen. A solution of 1.48 grams of initiator (AIBN) dissolved in 8.4 grams of N-methyl pyrrolidone was added to the reactor followed by 10 grams of ethylene diamine in 20 grams of water. The dispersion was heated to 65° C. and held there with stirring for 10 hours. The resulting dispersion of the urethane acrylic copolymer was used as polymer P1 having an acid number of 11.

All the protective overcoats were coated over paper that was previously coated with light sensitive emulsions in a formulation described below. The gelatin containing layers were hardened with bis(vinylsulfonyl methyl) ether at 1.95 weight % of the total gelatin weight.

TABLE 1

| | | Laydown (g/m2) |
|---|---|---|
| Layer 7 | Overcoat | |
| | Gelatin | 0.6456 |
| | Ludox AM ™ (colloidal silica) | 0.1614 |
| | Polydimethylsiloxane (DC200 ™) | 0.0202 |
| | 5-chloro-2-methyl-4-isothiazolin-3-one/2-methyl-4-isothiazolin-3-one (3/1) | 0.0001 |
| | SF-2 | 0.0032 |
| | Tergitol 15-S-5 ™ (surfactant) | 0.0020 |
| | SF-1 | 0.0081 |
| | Aerosol OT ™ (surfactant) | 0.0029 |
| Layer 6 | UV Layer | |
| | Gelatin | 0.8231 |
| | UV-1 | 0.0355 |
| | UV-2 | 0.2034 |
| | ST-4 | 0.0655 |
| | SF-1 | 0.0125 |
| | S-6 | 0.0797 |
| | 5-chloro-2-methyl-4-isothiazolin-3-one/2-methyl-4-isothiazolin-3-one (3/1) | 0.0001 |
| Layer 5 | Red Sensitive Layer | |
| | Gelatin | 1.3558 |
| | Red Sensitive silver (Red EM-1) | 0.1883 |
| | IC-35 | 0.2324 |
| | IC-36 | 0.0258 |
| | UV-2 | 0.3551 |
| | Dibutyl sebacate | 0.4358 |
| | S-6 | 0.1453 |
| | Dye-3 | 0.0229 |
| | Potassium p-toluenethiosulfonate | 0.0026 |
| | 5-chloro-2-methyl-4-isothiazolin-3-one/2-methyl-4-isothiazolin-3-one (3/1) | 0.0001 |
| | Sodium Phenylmercaptotetrazole | 0.0005 |
| | SF-1 | 0.0524 |
| Layer 4 | M/C Interlayer | |
| | Gelatin | 0.7532 |
| | ST-4 | 0.1076 |
| | S-3 | 0.1969 |
| | Acrylamide/t-Butylacrylamide sulfonate copolymer | 0.0541 |
| | Bis-vinylsulfonylmethane | 0.1390 |
| | 3,5-Dinitrobenzoic acid | 0.0001 |
| | Citric acid | 0.0007 |
| | Catechol disulfonate | 0.0323 |
| | 5-chloro-2-methyl-4-isothiazolin-3-one/2-methyl-4-isothiazolin-3-one (3/1) | 0.0001 |
| Layer 3 | Green Sensitive Layer | |
| | Gelatin | 1.1944 |
| | Green Sensitive silver (Green EM-1) | 0.1011 |
| | M-4 | 0.2077 |
| | Oleyl Alcohol | 0.2174 |

TABLE 1-continued

| | | Laydown (g/m2) |
|---|---|---|
| | S-3 | 0.1119 |
| | ST-21 | 0.0398 |
| | ST-22 | 0.2841 |
| | Dye-2 | 0.0073 |
| | 5-chloro-2-methyl-4-isothiazolin-3-one/2-methyl-4-isothiazolin-3-one (3/1) | 0.0001 |
| | SF-1 | 0.0236 |
| | Potassium chloride | 0.0204 |
| | Sodium Phenylmercaptotetrazole | 0.0007 |
| Layer 2 | Interlayer | |
| | Gelatin | 0.7532 |
| | ST-4 | 0.1076 |
| | S-3 | 0.1969 |
| | 5-chloro-2-methyl-4-isothiazolin-3-one/2-methyl-4-isothiazolin-3-one (3/1) | 0.0001 |
| | Catechol disulfonate | 0.0323 |
| | SF-1 | 0.0081 |
| Layer 1 | Blue Sensitive Layer | |
| | Gelatin | 1.3127 |
| | Blue sensitive silver (Blue EM-1) | 0.2399 |
| | Y-4 | 0.4143 |
| | ST-23 | 0.4842 |
| | Tributyl Citrate | 0.2179 |
| | ST-24 | 0.1211 |
| | ST-16 | 0.0095 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one (3/1) | 0.0002 |
| | SF-1 | 0.0366 |
| | Potassium chloride | 0.0204 |
| | Dye-1 | 0.0148 |
| | Photographic paper support | |

IC-35

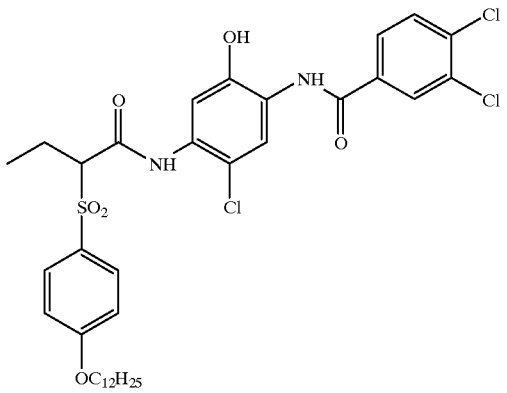

IC-36

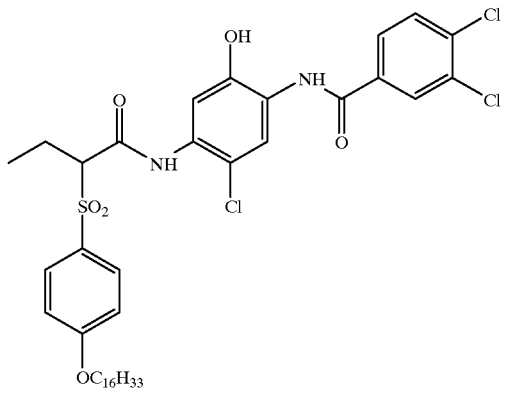

TABLE 1-continued
| | | Laydown (g/m2) |
|---|---|---|
| M-4 | 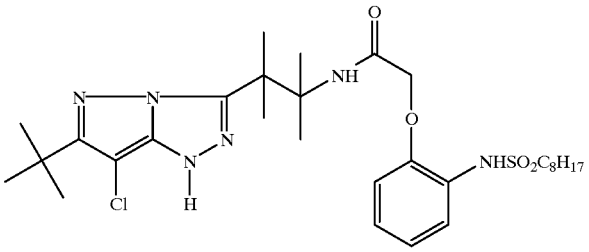 | |
| Y-4 | 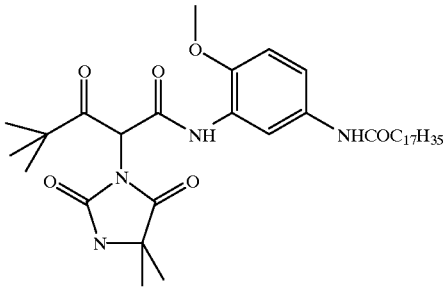 | |
| Dye-1 | 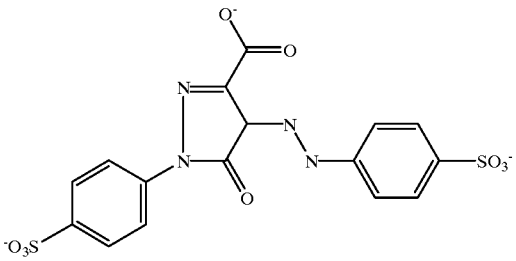 | |
| Dye-2 | 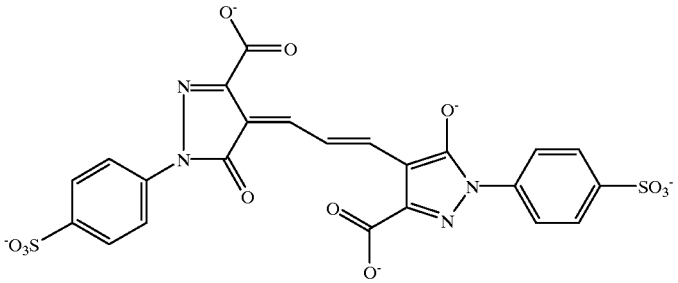 | |
| Dye-3 | 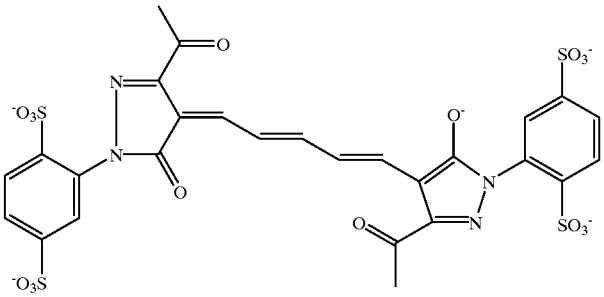 | |
| S-3 | Diundecyl phthalate | |
| S-6 | Tris(2-ethylhexyl)phosphate | |

TABLE 1-continued
| | | Laydown (g/m2) |
|---|---|---|
| ST-4 | 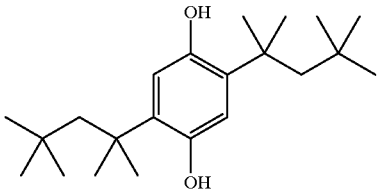 | |
| ST-16 | 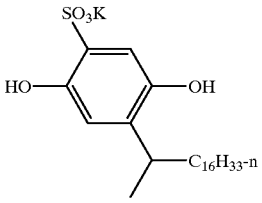 | |
| ST-21 | 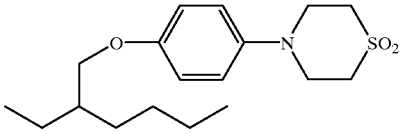 | |
| ST-22 | 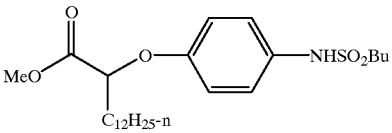 | |
| ST-23 | 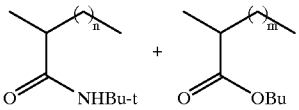 | |
| ST-24 | 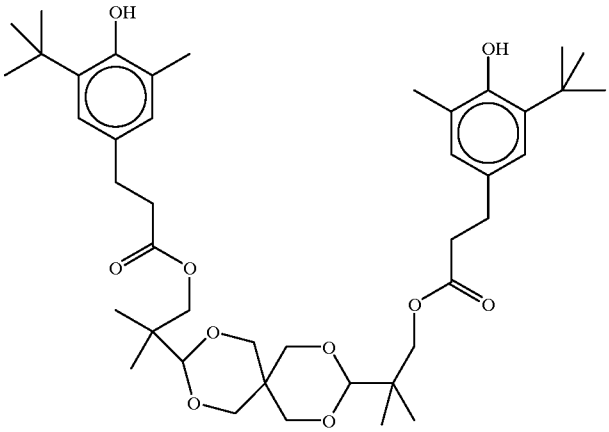 | |
| SF-1 | 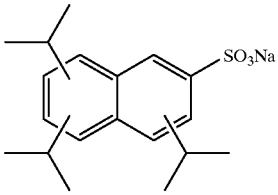 | |

TABLE 1-continued

| | | Laydown (g/m2) |
|---|---|---|
| SF-2 | $CF_3.(CF_2)_7.SO_3Na$ | |
| UV-1 | 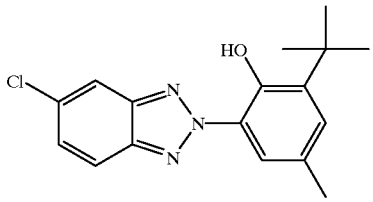 | |
| UV-2 | 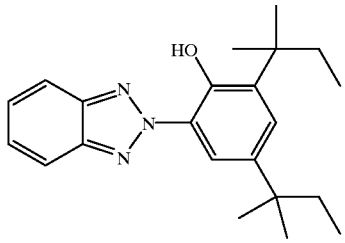 | |

Test for Reticulation

The samples were fully exposed to daylight, processed with the Kodak RA4 process and air-dried. The resulting Dmax samples were visually examined for reticulation and rated on a scale of 1–5, with 1 being a glossy sample with no observable surface defects and 5 being reduced gloss with observable and objectionable surface defects.

Examples 1–5

The urethane-vinyl copolymers P1 and NeoPac™ R9699, used to demonstrate the invention were coated over the sensitized paper support described earlier to obtain a nominal coverage of 1.08 g/m2 for the polymer. Polyvinyl alcohol, V2, was used at a level of 20 weight % of the polymer and CX100 at 0.5 and 1 weight % of the polymer as shown in Table 1. For comparision, a check paper as described previously, without the polymer was used (Example 1). The Table also shows the reticulation ratings that were assigned to the feature coatings as compared to the control. As Table 1 shows, the features Examples 2–5 were excellent for controlling reticulation compared to the control, Example 1, at 2 different crosslinker levels.

TABLE 2

| Example | Description (overcoat) | Weight % V2 of polymer | Weight % CX100 of polymer | Reticulation ratings |
|---|---|---|---|---|
| 1 | Check | 0 | 0 | 5 |
| 2 | P1 | 20 | 0.5 | 1 |
| 3 | P1 | 20 | 1 | 1 |
| 4 | NeoPac ™ R9699 | 20 | 0.5 | 1 |
| 5 | NeoPac ™ R9699 | 20 | 1 | 1 |

The invention has been described in detail with particular reference to certain preferred embodiments thereof, but it will be understood that variations and modifications can be effected within the spirit and scope of the invention.

What is claimed is:

1. A photographic element comprising:

a support;

at least two contiguous layers, at least one of which is a silver halide emulsion layer superposed on a side of said support;

a processing solution permeable protective overcoat comprising: a urethane-vinyl copolymer having acid functionalities and an acid number of from 5 to 30, wherein a weight ratio of a urethane component in the copolymer comprises from 20 to 100 percent and a weight ratio of a vinyl component in the copolymer comprises from 0 to 80 percent, a crosslinker for the said copolymer, and a second polymer selected from the group consisting of polyvinyl alcohol, cellulose ethers, n-vinyl amides, polyesters, poly(ethylene oxide), starch, proteins, whey, albumin, poly(acrylic acid), alginates and gums overlying the said at least two contiguous layers;

wherein the ratio of the gelatin to non-gelatin content of the dried layers immediately underlying the uppermost gelatin layer is less than 1.3 with the proviso that the water content of the wet coating of all the gelatin layers prior to drying is at a coverage of greater than 53 $g/m^2$.

2. The element of claim 1 wherein said silver halide emulsion layer contains silver halide grains comprised of at least 90 percent silver chloride and further comprise an iridium coordination complex containing a thiazole or substituted thiazole ligand.

3. The element of claim 1 wherein said silver halide emulsion layer comprise a coupler of the formula

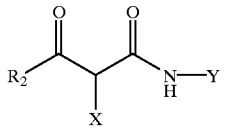

wherein X is hydrogen or a coupling-off group; Y represents an aryl group or a heterocyclic group; and $R_2$ represents a substituent selected from the group consisting of aryl and tertiary alkyl.

4. The photographic element of claim 1 wherein the support comprises a material selected from the group consisting of polymeric films, papers and glass.

5. The photographic element of claim 1 wherein the support is reflective.

6. The photographic element of claim 1 wherein the protective overcoat further comprises optional additives selected from the group consisting of UV absorbers, surfactants, emulsifiers, coating aids, lubricants, matte particles, rheology modifiers, antifoggants, inorganic fillers, pigments, magnetic particles and biocides.

7. The photographic element of claim 1 wherein the urethane-vinyl copolymer having acid functionalities comprises a weight ratio of urethane component:vinyl component of from 4:1 to about 1:4.

8. The photographic element of claim 1 further comprising an antistatic layer superposed on said support.

9. The photographic element of claim 1 further comprising a transparent magnetic layer superposed on said support.

10. The photographic element of claim 1 wherein the second polymer in the protective overcoat comprises 1 to 40 weight percent of the urethane-vinyl copolymer.

11. The photographic element of claim 1 wherein the protective overcoat further comprises polyfunctional aziridine as a crosslinker.

12. The photographic element of claim 4 wherein the support comprises a paper base; and a layer of biaxially oriented polyolefin sheet between a first side of said paper base and said at least one silver halide layer.

13. A method of making a photographic element having a developed image comprising the steps of:

providing a photographic element comprising a support, at least two contiguous layers, at least one of which one is a silver halide emulsion layer superposed on a side of said support; a processing solution permeable protective overcoat comprising: a urethane-vinyl copolymer having acid functionalities and an acid number of from 5 to 30 wherein a weight ratio of a urethane component in the copolymer comprises from 20 to 100 percent and a weight ratio of a vinyl component in the copolymer comprises from 0 to 80 percent, a crosslinker for the said copolymer, and a second polymer selected from the group consisting of polyvinyl alcohol, cellulose ethers, n-vinyl amides, polyesters, poly(ethylene oxide), starch, proteins, whey, albumin, poly(acrylic acid), alginates and gums overlying the said at least two contiguous layers;

wherein the ratio of the gelatin to non-gelatin content of the dried layers immediately underlying the uppermost gelatin layer is less than 1.3 with the proviso that the water content of the wet coating of all the gelatin layers prior to drying is at a coverage of greater than 53 $g/m^2$;

imagewise exposing the photographic element to light; and developing the photographic element in a developer solution having a pH greater than 7.

14. The method of claim 13 comprising the additional step of fusing the processing solution permeable overcoat.

15. The method of making a photographic element as in claim 13 wherein the fusing step further comprises texturizing a surface of the processing solution permeable overcoat.

16. A photographic element comprising:

a support;

at least two contiguous layers, at least one of which is a silver halide emulsion layer superposed on a side of said support;

a processing solution permeable continuous protective overcoat comprising:

a urethane-vinyl copolymer having acid functionalities, wherein a weight ratio of a urethane component in the copolymer comprises from 20 to 100 percent and a weight ratio of a vinyl component in the copolymer comprises from 0 to 80 percent, wherein the weight ratio of urethane component:vinyl component is from 4:1 to about 1:4, a crosslinker for the said copolymer, and a second polymer selected from the group consisting of polyvinyl alcohol, cellulose ethers, n-vinyl amides, polyesters, poly(ethylene oxide), starch, proteins, whey, albumin, poly(acrylic acid), alginates and gums overlying the said at least two contiguous layers;

wherein the ratio of the gelatin to non-gelatin content of the dried layers immediately underlying the uppermost gelatin layer is less than 1.3 with the proviso that the water content of the wet coating of all the gelatin layers prior to drying is at a coverage of greater than 53 $g/m^2$.

* * * * *